US011407022B2

(12) United States Patent
Bodin et al.

(10) Patent No.: US 11,407,022 B2
(45) Date of Patent: Aug. 9, 2022

(54) PROCESS AND APPARATUS FOR THE PRODUCTION OF A CAN BODY BY WALL IRONING

(71) Applicant: TATA STEEL IJMUIDEN B.V., Velsen-Noord (NL)

(72) Inventors: Andre Bodin, Santpoort-Noord (NL); Frederik Jonker, Heemskerk (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 18 days.

(21) Appl. No.: 16/967,178

(22) PCT Filed: Feb. 4, 2019

(86) PCT No.: PCT/EP2019/052573
§ 371 (c)(1),
(2) Date: Aug. 4, 2020

(87) PCT Pub. No.: WO2019/154743
PCT Pub. Date: Aug. 15, 2019

(65) Prior Publication Data

US 2021/0046538 A1 Feb. 18, 2021

(30) Foreign Application Priority Data

Feb. 6, 2018 (EP) ..... 18155405

(51) Int. Cl.
*B21D 51/26* (2006.01)

(52) U.S. Cl.
CPC ..... *B21D 51/2646* (2013.01)

(58) Field of Classification Search
CPC .... B21D 51/2646; B21D 51/26; B21D 22/28; B21D 22/20
See application file for complete search history.

(56) References Cited

U.S. PATENT DOCUMENTS 4,346,580 A * 8/1982 Saunders ..... B21D 45/065 72/344
4,534,201 A * 8/1985 LaRosa ..... B21D 22/30 72/348

(Continued)

FOREIGN PATENT DOCUMENTS

DE 2256334 A * 5/1974 ..... B21D 22/21
EP 0045115 A1 * 2/1982 ..... B21D 22/28

(Continued)

OTHER PUBLICATIONS

International Search Report and Written Opinion dated Jul. 5, 2019 for PCT/EP2019/052573 to Tata Steel Ijmuiden B.V. filed Feb. 4, 2019.

*Primary Examiner* — Adam J Eiseman
*Assistant Examiner* — P Derek Pressley
(74) *Attorney, Agent, or Firm* — Vorys, Sater, Seymour and Pease LLP

(57) ABSTRACT

A process for the production of a can body including a base and a tubular body from sheet metal which is coated on at least one side with a polymer layer, in which process, firstly, a round disc is produced from the sheet metal, which disc is then deep-drawn into a cup which has a polymer layer at least on the outside, after which this cup is formed into a can body by wall ironing, the wall ironing taking place in a single stroke by moving the cup successively through a redraw die and one or more wall-ironing rings.

18 Claims, 4 Drawing Sheets

(56) References Cited

U.S. PATENT DOCUMENTS

Figure 1:
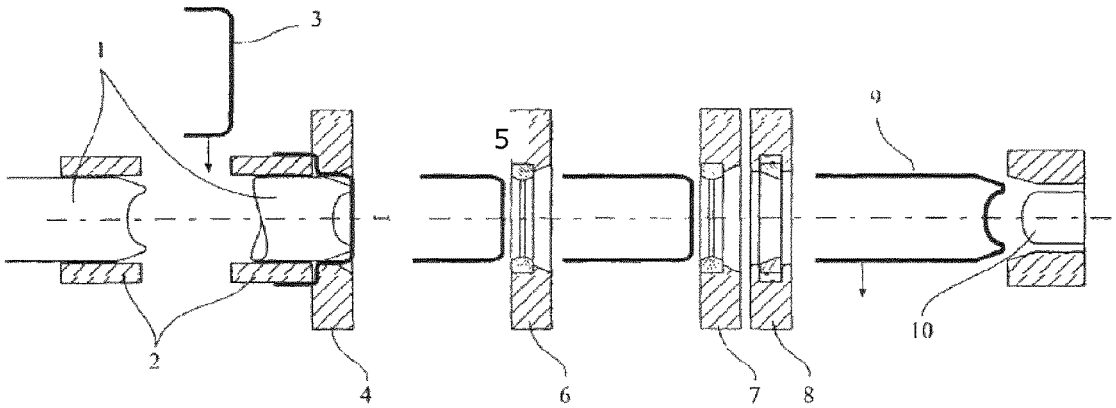

| | | | | | |
|---|---|---|---|---|---|
| 4,541,265 | A * | 9/1985 | Dye | B21D 22/24 | 72/347 |
| 5,782,375 | A * | 7/1998 | McHenry | B21D 51/26 | 220/62.12 |
| 6,122,814 | A * | 9/2000 | Pennig | B21D 17/02 | 29/412 |
| 8,727,155 | B2 * | 5/2014 | Oshima | B32B 15/08 | 220/4.01 |
| 2012/0119418 | A1 * | 5/2012 | Verbeek | B21D 51/2646 | 264/320 |

FOREIGN PATENT DOCUMENTS

| | | | | | |
|---|---|---|---|---|---|
| EP | 0402006 | A1 | 12/1990 | | |
| EP | 0402006 | B1 * | 4/1993 | B21D 22/30 | |
| GB | 2010720 | A * | 7/1979 | B21D 22/28 | |
| GB | 2547016 | A | 8/2017 | | |
| JP | 2000042644 | A * | 2/2000 | B21D 22/28 | |
| JP | 2000042644 | A | 2/2000 | | |
| WO | WO1999044766 | A1 * | 9/1999 | B21D 22/28 | |
| WO | 2009094763 | A1 | 8/2009 | | |
| WO | WO-2010150649 | A1 * | 12/2010 | B21D 22/28 | |

* cited by examiner

PROCESS AND APPARATUS FOR THE PRODUCTION OF A CAN BODY BY WALL IRONING

CROSS-REFERENCE TO RELATED APPLICATIONS

This is a § 371 National Stage Application of International Application No. PCT/EP2019/052573 filed on Feb. 4, 2019, claiming the priority of European Patent Application No. 18155405.6 filed on Feb. 6, 2018.

The invention relates to a process for the production of a can body comprising a base and a tubular body from sheet metal which is coated on at least one side with a polymer layer, in which process, firstly, a round disc is produced from the sheet metal, which disc is then deep-drawn into a cup which has a polymer layer at least on the outside, after which this cup is formed into a can body by wall ironing, the wall ironing taking place in a single stroke by moving the cup successively through one or more wall-ironing rings.

A process of this nature is described in EP0402006-A1, which is based on a laminate comprising an aluminium sheet. This patent proposes that the problems with processing of this laminate be solved by employing a combination of a proposed exit angle from a wall-ironing ring and an entry angle thereof which is selected between 1 and 4° and external cooling after each wall-ironing step. This patent also proposes a specific selection of material for the wall-ironing ring.

It has been found that various problems may arise with wall ironing for the production of a can body from a laminate based on a metal sheet and a polymer layer according to the method of the prior art. Some of these problems relate to the applied technology of processing polymer coated metal substrates. The polymer layer is softer than the metal sheet. During wall ironing of such a laminate the polymer layer near the open end of the can body may be pinched between the punch and the die and there is a risk of formation of polymer threads ("hairs") as a result.

The formation of these hairs should be prevented because any hairs becoming dislodged from the can may pollute the ironing tools or end up in the can body interior. If that happens, they must be removed by washing and drying the can because they may not end up in the filled can.

During wall ironing the shear forces can become excessively high in the coating itself. This excessive shear results in an increased risk of damaging the polymer layer. One type of damage is so called scuffing, which damages the coating and may result in contact between the metal substrate and the wall ironing tooling and/or a visually unacceptable can wall finish. Or in very severe cases rupture of the can body wall. It is therefore important that any changes in the deformation behaviour are performed as smoothly as possible.

It is the object of the invention to provide a process and an apparatus for wall ironing which prevents the formation of hairs at the can body wall edge.

It is also an object of the invention to provide a process and an apparatus for wall ironing which provides a smooth deformation behaviour of the laminate.

One or more of these objects is reached with the process according to independent claim 1 and dependent claims 2 to 6.

According to a second aspect the invention is also embodied in the apparatus according to independent claim 7 and dependent claims 8 to 12.

The process for the production of a can body comprising a base and a tubular body from sheet metal which is coated on one side with a polymer layer, comprises first producing a round disc from the sheet metal, which disc is then deep-drawn into a cup, wherein the outside of the cup is provided with said polymer layer, after which this cup is redrawn and subsequently formed into a can body by wall ironing, the wall ironing taking place in a single stroke by moving the redrawn cup successively through one or more wall-ironing rings by means of a punch. Preferably the sheet metal is a steel sheet.

The punch according to the invention comprises two cylindrical parts with one part having a larger diameter D0 than the other part of which the diameter is D1 (D0>D1). Both cylindrical parts are separated by a transition in which the diameter of the punch gradually decreases from the larger diameter D0 of the at the front end portion of the punch to the smaller diameter D1 of the rear end portion of the punch without any abrupt transitions. According to the invention this gradual decrease has to be smooth, and no abrupt changes may be present. These discontinuities in the transition portion may also cause discontinuities in the wall ironing process and thus be a source of damage of the polymer layer or disturbance in the wall-ironing process, which usually takes place at high speed and high volume.

Figure 7A:
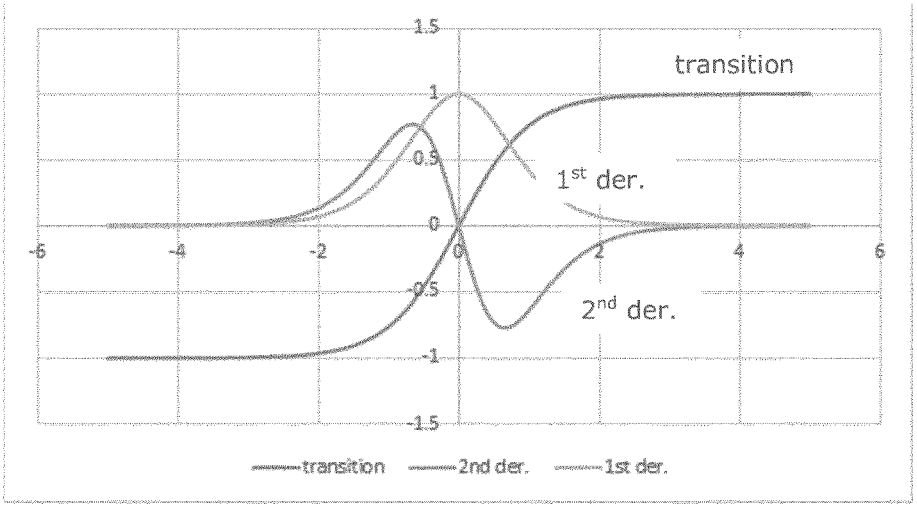
Figure 7B:
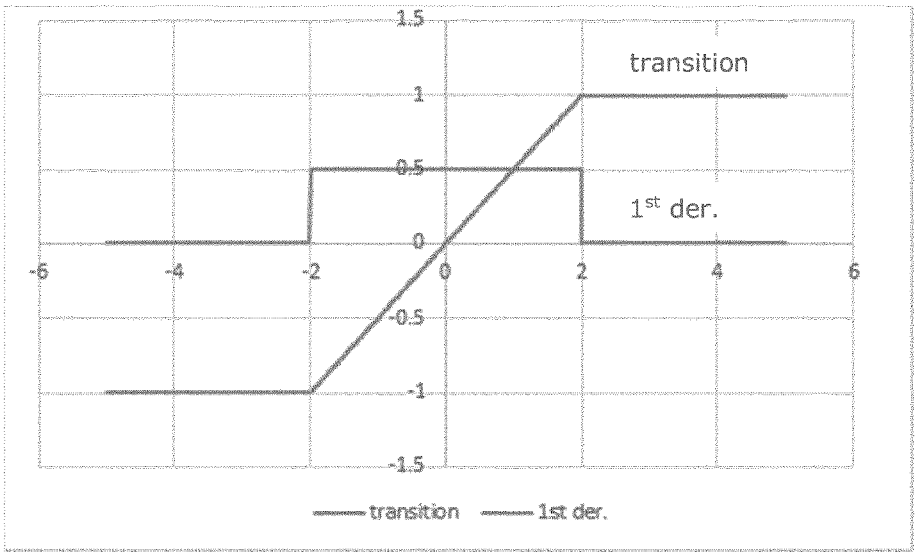

The gradual decrease from D0 to D1 can be obtained in several ways. By means of example, but by no means limited to it, the decrease can be described using a tan h-function. FIG. 7A shows the shape of the transition in a schematic way, and the decrease from D0 to D1 is exaggerated. However, the shape of the decrease is described by tan h(x) and in FIG. 7A also the first and second derivative is plotted. The smoothness of the first derivative shows that there are no discontinuities in the transition, and the second derivative shows that there is an inflection (at (0,0)) in the transition because the value of the second derivative changes sign at this point. The tapering angle ($\phi$) is not constant. The presence of the inflection point is required, because otherwise there can be no smooth transition at the connecting point of the transition portion to the rear end portion or of the transition portion to the front end portion. It is however not necessary that the inflection point is precisely in the middle of the transition portion. By choosing an appropriate function or combination of functions the inflection point can be nearer to the one or the other connecting point. FIGS. 7B and C show the same for a straight line transition between D0 and D1. It is clear that this transition is not smooth, with discontinuities in the first derivative, and no inflection point. The values for the second derivative at the kinks goes from 0 to infinity and back to zero, so there is no change of sign.

It is essential that the transition from D0 to D1 is smooth and gradual, with a non-constant tapering angle ($\phi$), and it is preferable that the transition from the transition portion to the rear end portion or the front end portion at the connecting points is also smooth. Therefore a function should be chosen to describe the transition that allows this. As shown in FIG. 7A the tangent of the tan h(x) at the extremities is such that the value of the first derivative is about zero. As the rear end portion and the front end portion are cylindrical, and preferably of constant diameter, the value of the function describing the rear end portion or the front end portion (i.e. a straight line) has a value for the first derivative of zero. Consequently the transition between the tan h(x) and the rear end portion or the front end portion at the connecting point can be made smooth.

Figure 7C:
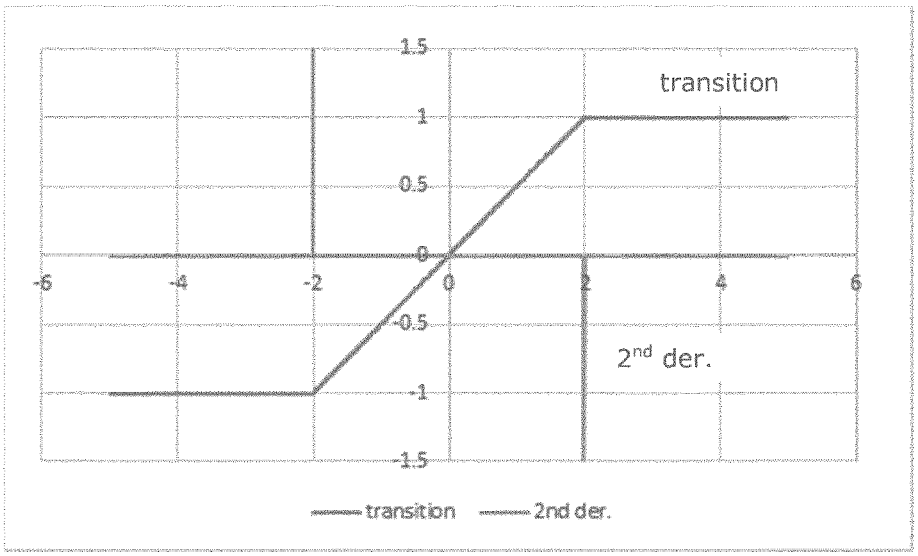

It is noted that a straight taper would also deliver a gradual decrease of the diameter from D0 to D1, but not a smooth one, because of the constant tapering angle. When choosing the tapered function of FIGS. 7B and 7C the kinks are machined and always have a very small radius as a result of the machining. However between these small radii the transition is tapered and the tapering angle ($\phi$) is constant. In that case there is no inflection point. The curve of the second derivative does not change sign, but becomes zero where the tapering angle is constant only to change sign upon reaching the end of the straight taper. It is noted that the punch according to the invention has no straight taper. When the polymer-coated metal substrate is processed with such a punch, then the polymer has to change direction at the transition where the tapering angle changes from 0 to $\phi$ and at the transition where the tapering angle changes from $\phi$ to 0. Each transition is abrupt, and not smooth, and can therefore cause irregularities in the flow of material during the ironing process, and any irregularity may be a cause for damage or disturbance in the process.

It is preferable that the used sheet metal is selected from the group of sheet metals consisting of (uncoated steel sheet (blackplate), tin coated steel sheet (tinplate), chromium-chromium oxide coated steel sheet (ECCS), tinplate which was diffusion annealed to form an iron-tin alloy consisting of at least 80% of FeSn (50 at. % iron and 50 at. % tin) thereupon, chromium-chromium oxide coated steel sheet produced by electroplating from a trivalent chromium electrolyte (TCCT)). It is also preferable that the entry angle ($\alpha$) for the first wall-ironing ring is between 3.5 and 4.5° and the exit angle ($\beta$) for the first wall-ironing ring is between 2.5 and 3.5°.

The invention therefore consists in the fact that, when a sheet metal is used which has been selected from the group consisting of i). uncoated steel sheet (blackplate), ii). tin coated steel sheet (tinplate), iii). chromium-chromium oxide coated steel sheet (ECCS), iv). tinplate which was diffusion annealed to form an iron-tin alloy consisting of at least 80% of FeSn (50 at. % iron and 50 at. % tin) thereupon, or v). a chromium-chromium oxide coated steel sheet produced by electroplating from a trivalent chromium electrolyte (TCCT), the advantage of the wall-ironing ring or rings according to the invention is that formation of hairs during wall ironing is prevented or minimised. If more than one ring is used, the entry angle for each successive wall-ironing ring has to be smaller than that of the preceding ring. In the second and any further wall-ironing rings following the first wall-ironing ring the entry angle should become smaller in order to prevent scuffing. It was found that the entry angle for the first wall-ironing ring should be between 3.5 and 4.5° in order to prevent the expansion force in this first ring becoming excessive.

It has been found that if the entry angles $\alpha$ for the wall-ironing rings 6 and 7 are made to conform with the conditions described above, good results for the surface of the can body 9 formed are obtained without producing impermissibly high expansion forces in the wall-ironing rings and, most importantly, without hairs. Such good results are obtained, for example, if the entry angles $\alpha$ for the wall-ironing rings 6 and 7 are selected, for example, to be 4° and 2°, respectively. Selecting the material of the polymer coating as described above results in cans with an intact coating, and the risk of hair forming or the coating becoming detached from the metal base is negligible.

Preferably, the process according to the invention is used without external coolant. With an external coolant a coolant is meant that is applied directly to the can during the wall-ironing operation as in EP0402006-A1. The coolant usually also contains lubricant or provides lubrication by itself to facilitate the wall-ironing operation. In the process according to the invention the polymer layers provide the lubrication. It is possible to use internal cooling in the form of internal cooling of the punch and/or the wall-ironing rings or the spacers between the rings. In this case no external coolant is necessary. This process, referred to as a dry process, is not hampered by large amounts of coolant that need to be processed and the can bodies need not be rinsed to remove the excess coolant and dried afterwards.

The polymer layer preferably comprises two or more layers, each with their specific properties. It is preferable to use a three-layer polymer coating system on each side of the substrate. The three layers of coating on each side of the substrate comprise an adhesion layer, a main layer and a surface layer with optimised interface properties, such as release properties, an optimised adhesion to steel is provided by the adhesion layer, and the main layer has a more general functionality such as providing barrier properties. The table below gives an overview.

The inventors found that it is beneficial if a cylindrical land zone having a length L is present between the entry and the exit of each wall ironing ring wherein L is at most 0.6 mm, preferably at most 0.5 mm, more preferably at most 0.3 mm, preferably wherein L of the first wall ironing ring is different from L of the second wall ironing ring.

The wall-ironed can body is sometimes very tightly adhered to the punch as a result of the smoothness of the punch and inner surface of the can body and the retained tension in the can. In an embodiment the reduction in the second wall-ironing ring (RED2) or, in case of more than two wall-ironing rings being used, the reduction in the last wall-ironing ring (RED_Last), is chosen such so as to remove tension in the can body thereby facilitating the stripping of the can body from the punch. For this purpose the reduction RED2 (or RED_Last) is preferably chosen low, preferably between 0.1 and 10%.

In a preferred embodiment the wall thickness of the cup is reduced by a value RED1 between 10 and 60% in the first wall-ironing ring and wherein, if present, the wall thickness is further reduced by a value RED2 of between 0.1 and 30% in the second wall-ironing ring. More preferably the wall thickness of the cup is reduced by a value RED1 between 20 and 55% in the first wall-ironing ring and/or the wall thickness of the cup is further reduced in the second wall-ironing ring by a value RED2 of at least 2%, preferably more than 5%.

EXAMPLES

A three layer polymer coating system with a total thickness of 30 μm is applied to one side of a steel strip (the side becoming the outside of the can) with a thickness of between 0.10 and 0.50 mm by means of film lamination. In this example the coated strip obtained is used to produce, in two steps, a cup with a diameter of 73 mm, the polymer-coated side forming the outside of the cup. In the first step, a cup with a diameter of 100 mm is deep drawn from a round disc with a diameter of 150 mm. In the second step, this cup is formed into a cup having the final diameter of 73 mm by a further deep-drawing operation. See FIG. 1 for the schematic representation. This cup is fed to a wall ironing machine in which the wall thickness of the cup is reduced by wall ironing at a speed of between 180 and 600 strokes per minute and using a redraw ring followed by a first wall-ironing ring with an entry angle $\alpha_1$ and an exit angle $\beta_1$, which reduces the wall thickness of the cup by a value (RED1) between 10 and 60% and a second wall-ironing ring an entry angle $\alpha_2$ and an exit angle $\beta_2$, which reduces the wall thickness of the cup by a value RED2 between 2 and 25%.

| Application | Adhesion layer | Main layer | Surface layer |
|---|---|---|---|
| Food | Optimised for sterilisation | Optimised for non-blushing performance or coating colour | Optimised for forming performance or content release |
| Aerosol | Optimised for heat resistance | Optimised for barrier performance or coating colour | Optimised for print |
| General Line (Paint) | Optimised for chemical resistance | Optimised for barrier properties or coating colour | |
| Beer and beverage | Optimised for adhesion | Optimised for barrier performance, deformation stresses and coating colour | Optimised for forming performance and print |

These experiments showed that an entry angle of 4° and an exit angle of 3° without external coolant provided excellent results with the majority of polymer coated strips. No scuffing was observed. Comparative experiments showed that the angle is critical in obtaining a good result. The method according to the invention is particularly suitable for polymer coatings which contain no or only insignificant amounts of titanium dioxide. However, the inventors found that white layers are somewhat more prone to scuffing because of the loading of the film with hard particles, such as $TiO_2$ which have an abrasive effect even though these films could also be processed with the settings as claimed. The inventors found that when using a white coating on the intended outside of the can which is pigmented with titanium dioxide that the entry angle $\alpha$ for the first wall-ironing rings is preferably between about 1.5 and 2.5°. This is believed to be caused by the hard titanium dioxide particles have a scouring effect that increases the risk of damage to the film when being processed with an entry angle for the first wall-ironing ring of between 3.5 and 4.5°. A white titanium dioxide pigmented coating can be further processed with the exit angle ($\beta$) of the first ring between 2.5 and 3.5° and an entry angle ($\alpha$) for the second wall-ironing ring, if present, of between 1.5 and 2.5° and the exit angle ($\beta$) is between 2.75 and 3.25°, similar to the method according to the invention.

Examples of successful combinations (OK = no scuffing, Not OK = scuffing or damaged, Just OK = acceptable), exit angle = 3°. *White film, $TiO_2$ pigment.

| # Rings | Entry angle (°) | Reduction RED1 (%) | Entry angle (°) | Reduction RED2 (%) | Result |
|---|---|---|---|---|---|
| 1 | 4 | 43 | — | — | OK |
| 1 | 4 | 32 | | | OK |
| 1 | 4 | 26 | | | OK |
| 1 | 4 | 45 | | | OK |
| 1 | 4 | 41 | | | OK |
| 1 | 4 | 31 | | | OK |
| 1 | 4 | 46 | | | OK |
| 1 | 4 | 45 | | | OK |
| 1 | 4 | 48 | | | OK |
| 1 | 4 | 50 | | | OK |
| 1 | 4 | 48 | | | OK |
| 1 | 4 | 48 | | | OK |

-continued

Examples of successful combinations (OK = no scuffing, Not OK = scuffing or damaged, Just OK = acceptable), exit angle = 3°. *White film, $TiO_2$ pigment.

| # Rings | Entry angle (°) | Reduction RED1 (%) | Entry angle (°) | Reduction RED2 (%) | Result |
|---|---|---|---|---|---|
| 1 | 4 | 25 | | | OK |
| 1 (Comparison) | 5 | 48 | | | Not OK |
| 2 | 4 | 48 | 2 | 6.9 | OK |
| 2 | | | 2 | 14.6 | OK |
| 2 | | | 2 | 21.5 | OK |
| 2 | | | 2 | 27 | OK |
| 2 | | | 2 | 13 | OK |
| 2 | | | 2 | 19.2 | OK |
| 2 | | | 2 | 10 | OK |
| 2 (Comparison) | 4 | 48 | 3 | 13 | Not OK |
| 2 (Comparison) | 4 | 48 | 4 | 13 | Not OK |
| 1* | 2 | 46 | — | — | OK |
| 1* | 2 | 50 | | | OK |
| 1* | 2 | 48 | | | OK |
| 1* | 2 | 25 | | | OK |
| 2* | 2 | 48 | 2 | 31 | OK |
| 2* | | | 2 | 50 | OK |
| 2* | | | 2 | 48 | OK |
| 2* | | | 2 | 25 | OK |
| 2*(Comparison) | 2 | 48 | 4 | 32 | Not OK |
| 2* | 4 | 45 | — | — | Just OK |

The polymer coated steel substrates that can be processed by the process according to the invention are preferably based on polycondensates, such as polyesters, co-polyesters (including PET, PBT, polyethylene furanoate (PEF), poly (lactic acid) (PLA)) or polyamides, polyolefins, elastomers, crystallisable polyaddition polymers, or any other polymer that can be formed in a film by extrusion. The polymer coating may consist of one or more layers. Preferably the polymer coating layer comprises or consists of polyethylene terephthalate, IPA-modified polyethylene terephthalate, CHDM-modified polyethylene terephthalate, polybutylene terephthalate, polyethylene naphthalate, polyethylene furanoate, poly (lactic acid) or copolymers or blends thereof.

Figure 2:
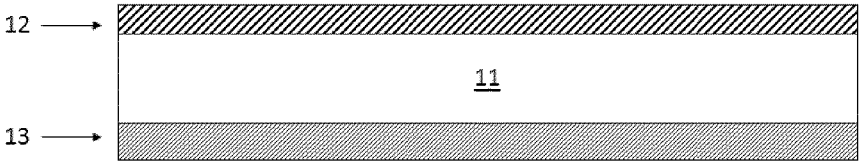
Figure 3:
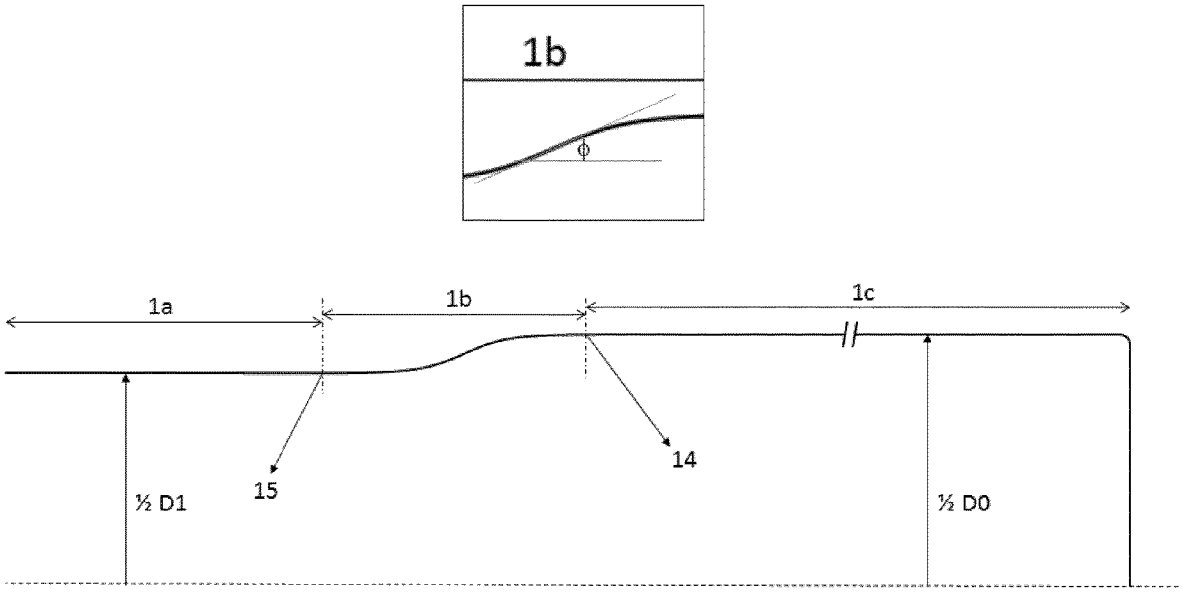
Figure 4:
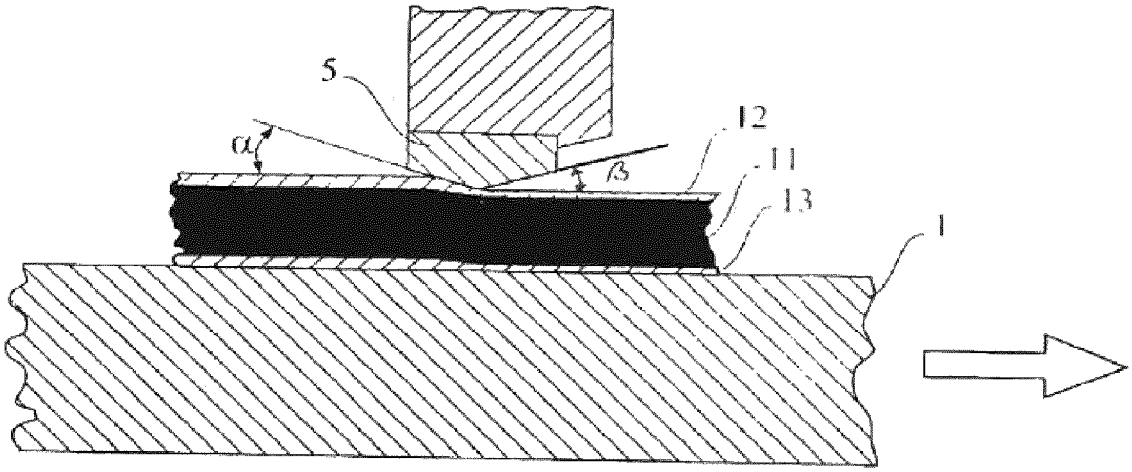
Figure 5:
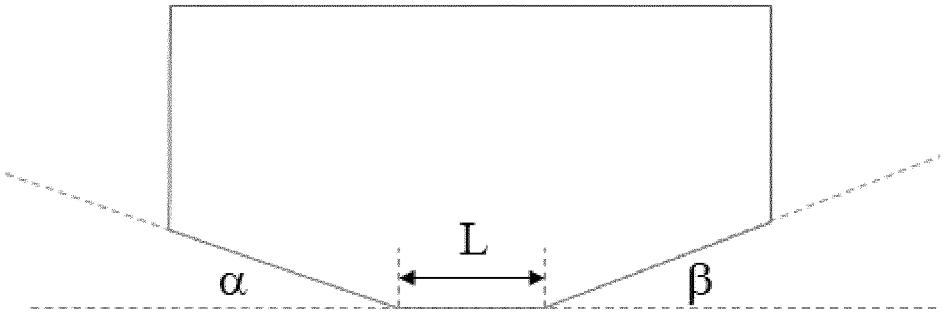

The procedure of the novel process and apparatus is illustrated in more detail in the appended figures, in which FIG. 1 shows various processing systems in various processing phases, FIG. 2 shows a schematic cross section of a polymer coated metal sheet, in this case provided with a polymer film on both sides. FIG. 3 shows a schematic and exaggerated portion of the punch with the rear end portion 1*a*, the transition portion 1*b* and the front end portion 1*c*, as well as the connecting points 14 and 15 and a cut out to illustrate the meaning of the tapering angle ($\phi$) in the transition. FIG. 4 shows a detail of a wall ironing operation and FIG. 5 shows a schematic detail of the workface of an ironing ring with a land zone between the (frusto-conical) entry and exit plane.

FIG. 1 illustrates how a preformed deep-drawn cup 3 is formed into a finished wall-ironed can body 9. The cup 3 is placed between a redraw sleeve 2 and a redraw die 4. When punch 1 moves to the right, the cup 3 is brought to an internal diameter of the final finished can 9 by the redrawing step.

Then, the punch 1 successively forces the product through (in this example) two wall-ironing rings 6 and 7. Ring 8 is an optional stripper ring. Wall ironing provides the can body 9 to be formed with its ultimate wall thickness and wall length. Finally, the base of can body 9 is formed by moving punch 1 towards an optional base tool 10.

Retracting punch 1 allows to detach can 9 from the punch 1 so that it can be discharged in the transverse direction. The optional stripper ring may assist in this. The can 9 is then subsequently trimmed, optionally necked and provided with a lid after filling.

FIG. 2 provides a detailed illustration of the passage of a part of the can wall to be formed through, for example, wall-ironing ring 5. Punch 1 is indicated diagrammatically.

The entry plane for wall-ironing ring 5 runs at an entry angle α to the direction of the axis of the wall-ironing ring. The thickness of the material of the wall to be formed is reduced between punch 1 and wall-ironing ring 5. This material comprises the actual metal can body wall 11 with layers of polymer 12 and 13 on either side. The layer of polymer 12 becomes the outside of the can body, and the layer of polymer 13 becomes the inside of the can body, eventually coming into contact with the contents of the can. The figure illustrates how the thickness of all three layers 11, 12 and 13 is reduced.

FIG. 5 shows a schematic detail of the workface of an ironing ring with a land zone between the (frusto-conical) entry and exit plane. The radii of the transfer between the land zone and the entry plane and the radius of the transfer between the land zone and the exit plane are between 0.1 and 10 mm, preferably between 0.2 and 5 mm.

The wall ironing rings are preferably provided with a land zone of length L which is located between connects the frusto-conical entry surface and the frusto-conical exit surface of the ring. The land zone is a cylindrical ring and has a length of at most 0.6 mm, preferably of at most 0.5 mm, and even more preferably of at most 0.3 mm.

Figure 6:
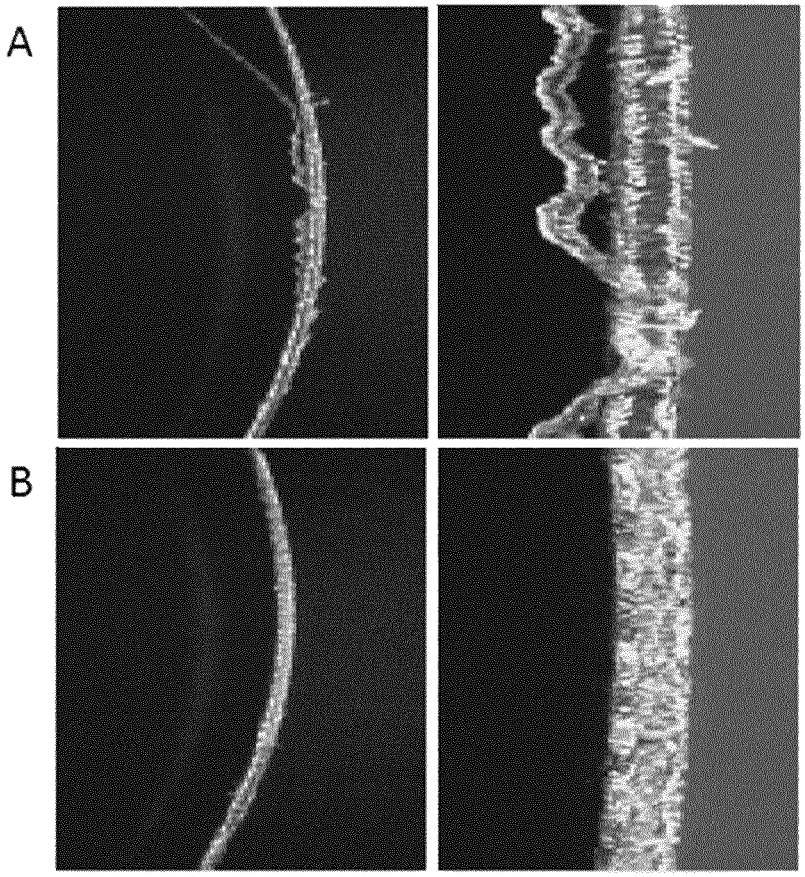

FIG. 6 shows an example of the prior art process with a straight punch where there is significant hair formation (A) and in the bottom half (B) the punch according to the invention shows no hair formation.

The invention claimed is:

1. A process for producing a can body comprising a base and a tubular body from sheet metal which is coated on one or both sides with a polymer film, the process comprising:

producing a round disc from the coated metal sheet, then deep-drawing the disc into a cup, followed by redrawing the cup and subsequently forming the redrawn cup into a can body by wall ironing, the wall ironing taking place in a single stroke by moving the redrawn cup successively through one or more wall-ironing rings by means of a punch, wherein the punch has a front end wall and sidewalls, the front end wall for contacting the base, the sidewalls defining a cylindrical front end portion with a diameter D0, a transition portion, and a rear end portion toward a rear end of the punch with a diameter D1, wherein D1<D0 and wherein the front end portion is separated from the rear end portion by the transition portion, wherein the diameter of the punch sidewalls gradually decreases over the transition portion and wherein the shape of the transition portion of the front end portion of the punch to the rear end portion is a continuous curve wherein the tapering (a) angle between the tangent of the curve and the centreline of the punch is not constant over the transition portion and wherein the first derivative of the curve has at least one inflection point in the transition portion, wherein the sheet metal is a steel sheet, wherein the tangent of the continuous curve at the connecting point between the curve and the front end portion and/or at the connecting point between the curve and the rear end portion is equal to the tangent of the front end portion and/or the rear end portion respectively to provide smooth transfer from curve to punch.

2. The process according to claim 1, wherein the tangent of the continuous curve at the connecting point between the curve and the front end portion and at the connecting point between the curve and the rear end portion is equal to the tangent of the front end portion and the rear end portion respectively to provide smooth transfer from curve to punch.

3. The process according to claim 1, wherein the coated metal sheet is obtained by means of film lamination or direct extrusion coating at least one surface of a metal sheet with an organic resin, wherein the organic resin is a polyester resin and the resin film has a thickness of 5 to 100 μm in case of a single-layer film or a total thickness of 5 to 100 μm in case of a multi-layer film.

4. The process according to claim 3, wherein the sheet metal is coated on both sides with a polymer film.

5. The process according to claim 1, wherein an entry angle (α) for the first wall-ironing ring is between 3.5 and 4.5° and an exit angle (β) for the first wall-ironing ring is between 2.5 and 3.5°.

6. The process according to claim 1, wherein no external coolant is directly applied to the can body during the wall-ironing operation.

7. The process according to claim 1, wherein the sheet metal is selected from a group of sheet metals consisting of uncoated steel sheet (blackplate), tin coated steel sheet (tinplate), chromium-chromium oxide coated steel sheet (ECCS), tinplate which was diffusion annealed to form an iron-tin alloy consisting of at least 80% of FeSn (50 at. % iron and 50 at. % tin) thereupon, chromium-chromium oxide coated steel sheet produced by electroplating from a trivalent chromium electrolyte (TCCT).

8. A wall ironing apparatus having a punch and one or more wall-ironing rings for reducing the wall thickness of a redrawn cup by forcing the redrawn cup through the one or more wall-ironing rings by the punch wherein the punch has a front end wall and sidewalls, the front end wall for contacting a base of the cup, the sidewalls defining a cylindrical front end portion with a diameter D0, a transition portion, and a rear end portion toward a rear end of the punch with a diameter D1, wherein D1<D0 and wherein the front end portion is separated from the rear end portion by the transition portion, wherein the diameter of the punch sidewalls gradually decreases over the transition portion and wherein the shape of the transition portion of the front end portion of the punch to the rear end portion is a continuous curve wherein the angle between the tangent of the curve and the centreline of the punch is not constant over the transition portion and wherein the first derivative of the curve has at least one inflection point in the transition portion, wherein the tangent of the continuous curve at the connecting point between the curve and the front end portion and/or at the connecting point between the curve and the rear end portion both its ends is equal to the tangent of the front end portion and/or the rear end portion respectively to provide smooth transfer from curve to punch.

9. The apparatus according to claim 8, wherein the tangent of the continuous curve at the connecting point between the curve and the front end portion and at the connecting point between the curve and the rear end portion is equal to the tangent of the front end portion and the rear end portion respectively to provide smooth transfer from curve to punch.

10. The apparatus according to claim 8, wherein D0 is constant or wherein both D0 and D1 are constant.

11. The apparatus according to claim 8, wherein an entry angle (α) for the first wall-ironing ring is between 3.5 and 4.5° and an exit angle (β) for the first wall-ironing ring is between 2.5 and 3.5°.

12. The apparatus according to claim 8, wherein additional wall-ironing rings, positioned behind the first wall-ironing ring, are used wherein the entry angle of each successive wall-ironing ring is smaller than that of the preceding ring.

13. The apparatus according to claim 8, wherein the second wall-ironing ring is present and the entry angle (α) for the second wall-ironing ring is at least 1.75 and at most 2.25°.

14. A can produced according to the process of claim 1.

15. The process according to claim 2, wherein the coated metal sheet is obtained by means of film lamination or direct extrusion coating at least one surface of a metal sheet with an organic resin, wherein the organic resin is a polyester resin and the resin film has a thickness of 5 to 100 μm in case of a single-layer film or a total thickness of 5 to 100 μm in case of a multi-layer film.

16. The process according to claim 15, wherein the sheet metal is coated on both sides with the polymer film.

17. The apparatus according to claim 9, wherein D0 is constant or wherein both D0 and D1 are constant.

18. The apparatus according to claim 17, wherein an entry angle (α) for the first wall-ironing ring is between 3.5 and 4.5° and an exit angle (β) for the first wall-ironing ring is between 2.5 and 3.5°.

* * * * *